US006345930B1

(12) United States Patent
Mohassel

(10) Patent No.: US 6,345,930 B1
(45) Date of Patent: Feb. 12, 2002

(54) MANUALLY OPERABLE RETRACTABLE BOLLARD

(76) Inventor: Parvis Mohassel, 55 Bethune St., Apt. 347B, New York, NY (US) 10014

( * ) Notice: Subject to any disclaimer, the term of this patent is extended or adjusted under 35 U.S.C. 154(b) by 0 days.

(21) Appl. No.: 09/539,501

(22) Filed: Mar. 30, 2000

(51) Int. Cl.[7] ..... E01F 13/04
(52) U.S. Cl. ..... 404/9; 404/6
(58) Field of Search ..... 404/6, 9, 10, 11; 49/49, 131; D25/126

(56) References Cited

U.S. PATENT DOCUMENTS

| | | | | | |
|---|---|---|---|---|---|
| 2,610,502 | A | * | 9/1952 | Carlson | 404/6 |
| 3,279,133 | A | * | 10/1966 | Korte | 52/103 |
| 3,660,935 | A | | 5/1972 | Boots | 49/35 |
| 3,698,135 | A | * | 10/1972 | Boots et al. | 49/35 |
| 4,003,161 | A | | 1/1977 | Collins | 49/35 |
| 4,240,766 | A | * | 12/1980 | Smith et al. | 404/10 |
| 4,576,508 | A | | 3/1986 | Dickinson | 404/6 |
| 4,666,331 | A | * | 5/1987 | Riley | 404/6 |
| 4,715,742 | A | | 12/1987 | Dickinson | 404/6 |
| 4,762,439 | A | | 8/1988 | Carlyle | 404/6 |
| 4,919,563 | A | * | 4/1990 | Stice | 404/6 |
| 5,054,237 | A | * | 10/1991 | Kapala et al. | 49/35 |
| 5,192,159 | A | * | 3/1993 | Higginson | 404/11 |
| 5,207,175 | A | * | 5/1993 | Andonian | 116/209 |
| 5,340,103 | A | * | 8/1994 | Kirby et al. | 273/32 H |
| 5,425,595 | A | | 6/1995 | Roper | 404/9 |
| 5,441,359 | A | * | 8/1995 | Filippi | 404/6 |
| 5,481,828 | A | | 1/1996 | Kentrotas | 49/35 |
| 5,509,754 | A | * | 4/1996 | Conigliaro | 404/9 |
| 5,520,479 | A | * | 5/1996 | Hernandez | 404/6 |
| 5,809,733 | A | * | 9/1998 | Venegas, Jr. | 52/721.5 |
| 5,961,249 | A | | 10/1999 | Hansen et al. | 404/9 |
| 5,975,792 | A | | 11/1999 | Goeken et al. | 404/6 |
| 6,099,200 | A | * | 8/2000 | Pepe et al. | 404/6 |

FOREIGN PATENT DOCUMENTS

| | | | | |
|---|---|---|---|---|
| FR | 2710354 | * | 3/1995 | E01F/13/04 |
| FR | 2735163 | * | 12/1996 | E01F/13/04 |
| JP | 6-49819 | * | 6/1994 | E01F/13/00 |
| WO | 98/10144 | * | 3/1998 | E01F/13/04 |

* cited by examiner

*Primary Examiner*—Thomas B. Will
*Assistant Examiner*—Kristine Markovich
(74) *Attorney, Agent, or Firm*—Steven Horwitz

(57) ABSTRACT

A retractable versatile bollard of simple construction is made of stainless steel. The post is generally cylindrical in shape and, when the bollard is in stored position, the post sits in a sleeve in the ground below grade level. In active position, the post can be grasped by a handle and pulled up by human effort to where only a lower portion remains submerged underground. The lower portion of the cylindrical post has spiral threading that mates with spiral grooves at an upper sleeve portion of the sleeve when the post is turned after first raising the post to an appropriate point. Bollard has a safety lock for permitting the post to be raised from a stored position to an active position and a double lock that prevents it to from being easily lowered by mischievous individuals from the raised active position to the stored position.

8 Claims, 3 Drawing Sheets

MANUALLY OPERABLE RETRACTABLE BOLLARD

The present invention relates to traffic barriers and more particularly to manually retractable bollards.

Bollards are barriers that are used on urban plazas to prevent pedestrians or vehicles from entering an area. Since having a permanent bollard stationed to prevent access by vehicles to a particular plaza would result in blocking access by emergency vehicles it is very helpful if bollards would be retractable. As a result of the desire to have a bollard that is retractable, prior art bollards tend to be complicated to manufacture and operate and many of them are inoperable by single individuals.

Besides being complicated to manufacture and operate, many prior art retractable bollards require excavation of large areas of pavement. Some prior art retractable bollards cannot be made to too high a height since it would be too heavy.

Many prior art bollards operate based on hydraulic mechanisms or pneumatic springs which are affected by power and mechanical failure. Other prior art bollards require electrical power. Certain prior art bollards are manually operable but suffer from other drawbacks including but not limited to the fact that they are not sturdy and they do not retract fully below grade. U.S. Pat. Nos. 3,660,935, 4,576,508, 4,715,742, 5,481,828, 5,975,792 disclose various kinds of bollards.

The present invention addresses these concerns and provides a bollard that has all of the appropriate and necessary characteristics. It is not necessary to excavate a large square foot area of the pavement in order to install the bollard of the present invention. The bollard of the present invention can be made to fit any suitable size.

In sum, the bollard of the present invention is retractable: and of simple construction and is made of stainless steel to limit site maintenance such as panting, repair of corrosion, etc. The bollard comprises a cylindrical post that is slidably disposed in a sleeve below grade level. In active position, the post can be grasped by a handle and pulled up by human effort to where only a lower portion remains submerged underground. The lower portion of the cylindrical post has spiral threading that mates with spiral grooves at an upper sleeve portion of the sleeve when the post is turned after first raising the post to an appropriate point. A safety lock permits the post to be raised from a stored position to an active position and a double lock that prevents it to from being easily lowered by mischievous individuals from the raised active position to the stored position. These and other important features will be described in further detail below.

OBJECTS AND ADVANTAGES

The following objects and advantages of the present invention are:

(a) to provide a simple to use, simple to manufacture and versatile stainless steel bollard that can be made to the desired size and height which comprises a post that slides in an out of a sleeve located below grade level, (b) to provide a bollard that does not require excavation of a large square foot area of pavement to install, (c) to provide a bollard that is manually operable and retractable so that access can be blocked to a particular area while not denying access to the area by emergency vehicles when appropriate, (d) to provide a bollard that can be raised and lowered with a handle, (e) to provide a bollard that has a lock that has to be unlocked before the post can be raised from a stored position to an active position and a double lock that governs whether the post can be lowered from the raised active position to the stored position, (f) to provide a bollard having a post that has spiral threading and a sleeve that has spiral grooves so that when the bollard that is raised to a point where an upper part of the spiral threading of the post is adjacent to the lower part of the spiral grooves of the sleeve, the post may be turned clockwise to its fully raised position.

(g) to provide a bollard that has a cushion to cushion the impact of lowering the post, (h) to provide a bollard that has a handle including a smooth outer surface of a top edge that can receive engraved lettering identifying the plaza or street location, and (i) to provide a bollard that allows a rope to be inserted into it in raised position so that the bollard can be connected to other barriers for cordoning off an area such as to enable queuing of people.

DETAILED DESCRIPTION OF THE DRAWINGS

Figure 5:
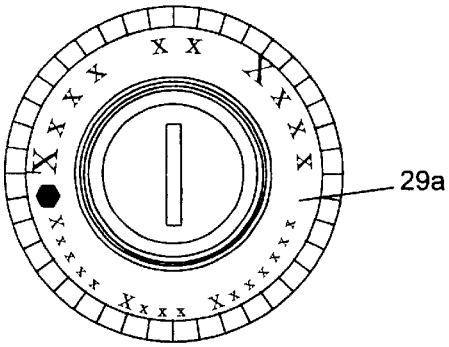
FIG. 5 is a top plan view of the handle of the bollard of the present invention.

In order to better understand the present invention in conjunction with the drawings of FIGS. 1–9, the bollard of the present invention has been assigned reference numeral 10 and its elements are described and assigned the reference numerals identified below.

Bollard 10 is comprised mainly of a sleeve 30 and a post 20. Sleeve 30 is a stainless steel, hollow, and cylindrical. Sleeve 30 is situated below grade level 100 or more precisely is flush with grade level 100. Sleeve 30 is open at a top end 33 and is partially open for drainage at a bottom end 39.

Post 20 is a stainless steel hollow cylindrical post 30 that is slidably disposed in the hollow cylindrical sleeve 30. Post 20 includes a bottom post portion 22. Post 20 is capable of being raised from a stored position in the sleeve 30 below grade level 100 to a fully raised active position above the grade level 100. The term "raised fully" does not mean, however, that the entire post 20 is outside of sleeve 30 but rather that post 20 is raised to its maximum extent in accordance with the present invention. Post 20, when raised fully to active position, functions as a barrier, usually a traffic barrier, to prevent vehicles from accessing a particular area. Alternatively, post 20 can be used a barrier together with other similarly raised bollard posts connected to one another by a rope to cordon off a line of people or to cordon off an area. Since post 20 is hollow it has an inside cavity 27. Its hollowness makes post 20 more lightweight and easier to raise and lower while at the same time the stainless steel material that post 20 is made of makes it strong and durable for its purposes as an effective, tamper-proof barrier. The present invention contemplates other materials for the bollard 10 of the present invention in addition to stainless steel that are strong and durable and achieve the same results.

Bottom post portion 22 including spiral threading 24 on an outside part 24a thereof an upper sleeve portion 32 of the sleeve 30 having a length approximately equal to a length of the spiral threading 24 and containing spiral grooves 34 adapted for receiving the spiral threading 24. After post 20 is raised to the point at which upper part 25 of the spiral threading 24 reaches and is adjacent to lower part 35 of the spiral grooves 34, post 20 may be turned clockwise to raise post 20 to its fully raised active position. This turning of post 20 amounts to a mating of spiral threading 24 of post 20 with spiral groves 34 of sleeve 30. Normally, lengths of spiral grooves 34 and spiral threading 24 are chosen so that when post 20 is in fully raised active position, approximately one twelfth of post 20 remains below grade level. Typically the spiral threading 24 is approximately 12 inches.

Figure 4:
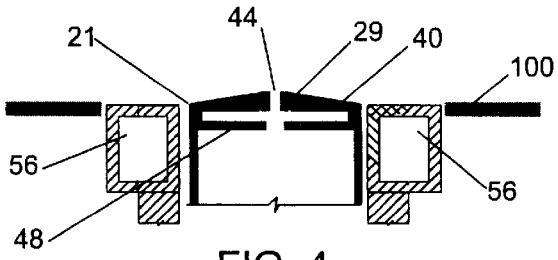
FIG. 4 is a detailed cross-sectional view of the handle and the surrounding area.

As best seen in FIG. 4, post 30 includes stainless steel handle 40 formed by a top edge 29 of the post 20. Handle 40 is used for raising and lowering the cylindrical post 20. Handle 40 cannot be grasped without a controlling key 45 since the top edge 29 has a smooth outer surface 29*a*. Handle 40 includes top edge 29 of post 20. Top edge 29 is sloped downward from a centered aperture 44 toward an outer circumference 21 of the post 20 for drainage purposes and also for drainage purposes centered aperture 44 forms a passageway to the inside cavity 27. Handle 40 of post 20 can be grasped by inserting an "I" shaped controlling key 45 (see FIG. 8) in aperture 44, turning controlling key 45 so that controlling key 45 is in a void 47 formed between top edge 29 and flange 48 extending below top edge 29, and then lifting controlling key 45. Smooth outer surface 29a can have lettering designating a street location engraved thereon (see FIG. 5).

Figure 6:
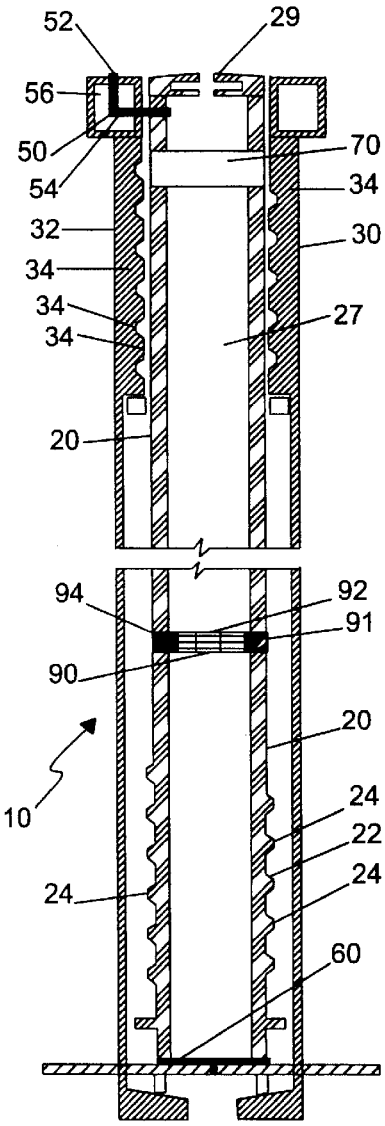
FIG. 6 is a fragmentary vertical cross-sectional view of the bollard of the present invention in stored position.
Figure 7:
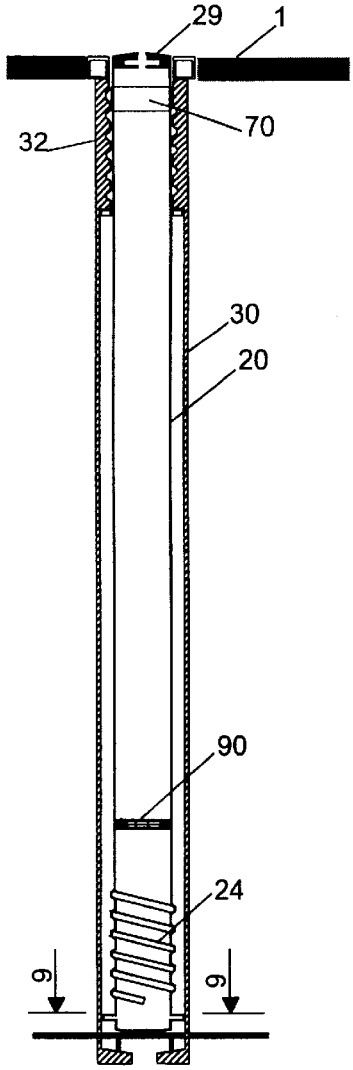
FIG. 7 is a front elevational view of the bollard of the present invention in stored position.
Figure 9:
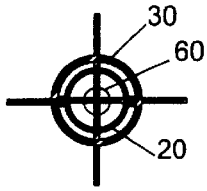
FIG. 9 is a cross-sectional view of the bollard of the present invention taken along line 9—9 of FIG. 7.
Figure 10:
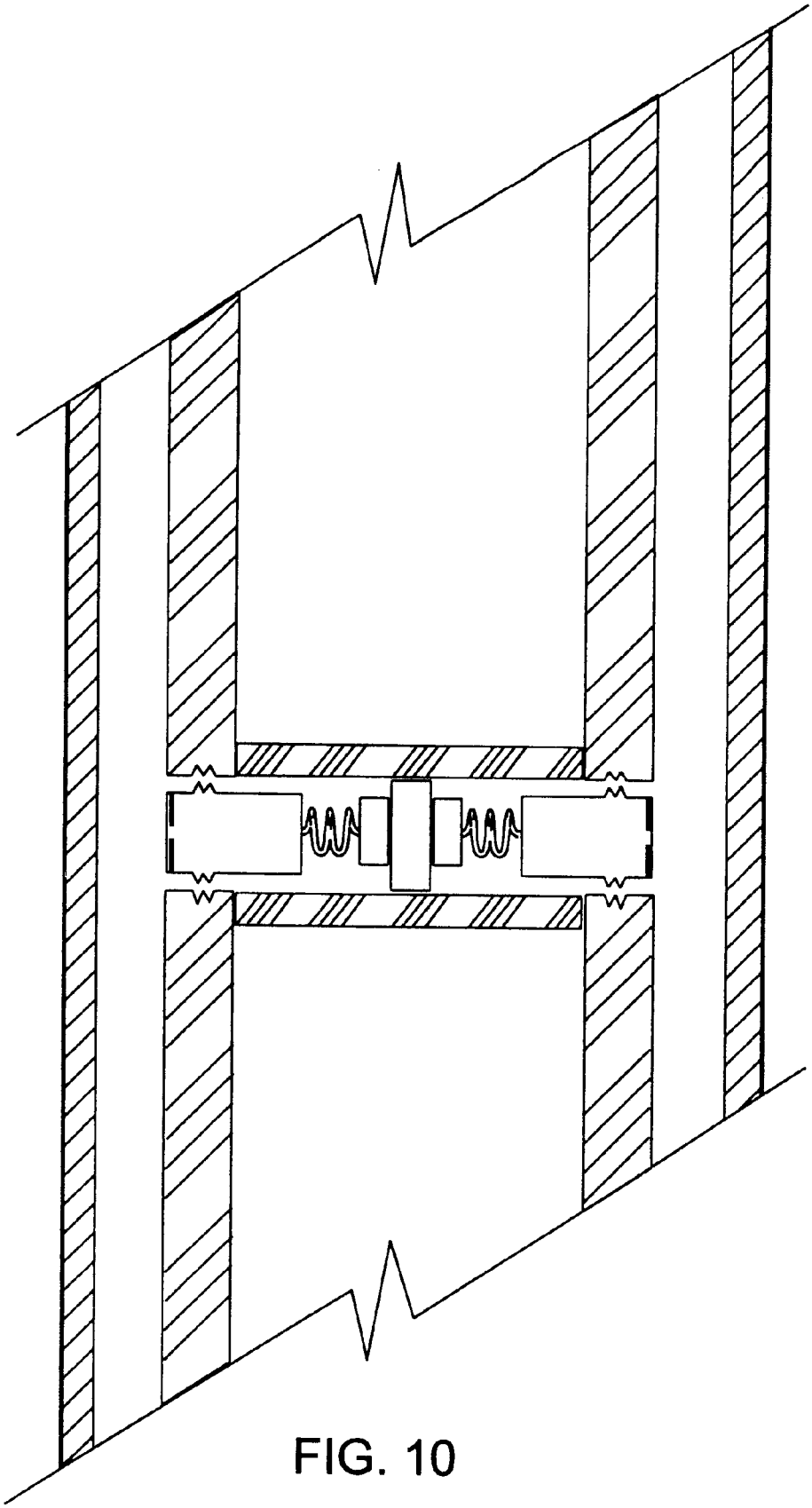
FIG. 10 is an enlarged view of a portion of FIG. 6 showing the double lock.

As seen in FIG. 6, bollard 10 also includes safety lock 50 to control movement of the post from the stored position to the fully raised active position. Safety lock 50 comprises an "L"-shaped finger 50 having vertical section 52 and horizontal section 54. Finger 50 is located in slot 56 in sleeve 30, slot 56 being situated just above the upper sleeve portion 32. Finger 50 has a generally square cross-section, at least at its vertical section 52. Accordingly, vertical section 52 may be shaped to be turned by a key having a hollow rod at its end that can be placed surrounding all or part of vertical section 52 and then used to turn vertical section 52 of finger 50. Horizontal section 54 of finger 50 extends into the cavity 27 in stored position. When one desires to raise post 20, finger 50 is turned using the appropriate key and horizontal section 54 is rotated out of cavity 27 and post 20, as best seen by FIG. 6.

Figure 2:
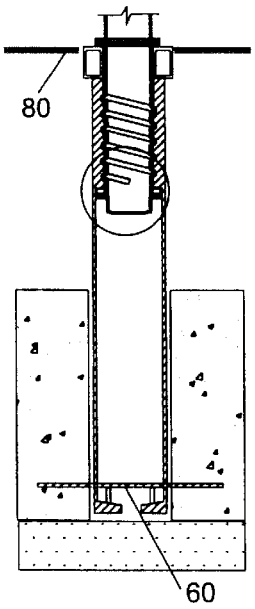
FIG. 2 is a front elevational detailed view of the bollard of the present invention in fully raised active position showing the below grade level portion of the bollard and the double-lock.
Figure 3:
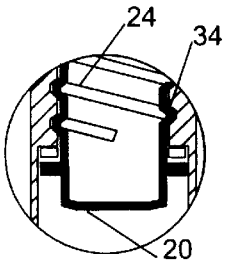
FIG. 3 is a detailed view of a portion of FIG. 2 detailing the spiral threading and the spiral grooves.
Figure 1:
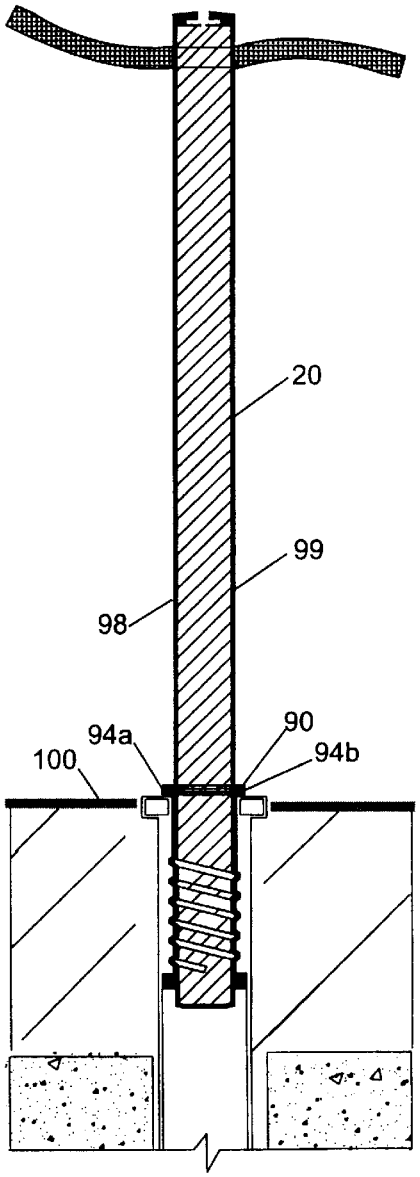
FIG. 1 is a vertical cross-sectional view of the bollard of the present invention in fully raised active position.
Figure 8:
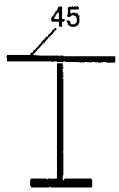
FIG. 8 is a side elevational view of the controlling key used for the handle

Since bollard 10 is made of stainless steel, there could be a significant impact from lowering post 20 back into sleeve 30, especially if post 20 were dropped, which may be the easiest way of lowering post 20. Accordingly, as best seen in FIGS. 2 and 6, rubber cushion 60 is provided. Cushion 60 crosses sleeve 30 near the lowest point that post 20 gets to in sleeve 30. Cushion 60 cushions an impact from lowering the post into the sleeve 30 below grade level 100 to a stored position. Rubber cushion 60 has small hole in its center for drainage purposes.

As best seen in FIG. 6, hollow tube 70 traverses a horizontal cross-section of the post 20 above the spiral threading 24. Hollow tube 70 receives a rope 80 used to connect the bollard 10 to other barriers.

In a preferred embodiment, bollard 90 also includes spring-loaded double-lock 90 that contains spring 92 and rod 94. Double-lock 90 is situated in horizontal groove 91 that traverses a diameter of post 20. Double-lock 90 is used to prevent post 20 from being turned and lowered when post 20 is in fully raised active position. Spring-loaded double-lock 90 is situated just above the grade level 100 when post 20 is in fully raised active position. In stored position of post 20, spring 92 and rod 94 are normally biased against a side wall 98 and an opposite side wall 99 of post 20. When post 20 is in raised active position, spring 92 and rod 94 are released by second key 95 inserted in groove 91 at side wall 98. Upon release, rod 94 forms two lips 94*a*, 94*b* outside side walls 98, 99 of post 20. To unlock double-lock 90 and allow post to be lowered, just push lips 94*a*, 94*b* in toward side wall 98 and opposite side wall 99 of post 20 such as by use of a standard Allen wrench to turn and engage rod 94. Then post 20 can be lowered by first turning post counterclockwise and then dropping or lowering post 20. The primary purpose of double-lock 90 is to prevent mischievous individuals from lowering the bollard 10 when it is in raised position.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof It is not desired to limit the invention to the exact construction and operation shown and described. The spirit and scope of this invention are limited only by the spirit and scope of the following claims.

What is claimed is:

1. A simple, manually operable, retractable, safe and versatile bollard for use as a traffic barrier, comprising:

a hollow cylindrical sleeve situated below and flush with a grade level and open at a top end, a hollow cylindrical post slidably disposed in said hollow cylindrical sleeve, said hollow cylindrical post including a bottom post portion, the post capable of being raised from a stored position in the sleeve to a fully raised active position above the grade level to function as a barrier, the post having an inside cavity, the bottom post portion including spiral threading on an outside part thereof, an upper sleeve portion of the sleeve having a length approximately equal to a length of the spiral threading and containing spiral grooves adapted for receiving the spiral threading after the post is disposed so that an upper part of the spiral threading reaches a lower part of the spiral grooves and the post is turned clockwise, a handle of the cylindrical post formed by a top edge of the post for raising and lowering said cylindrical post, said top edge being smooth enough so that said handle is incapable of being grasped without a controlling key, a safety lock to control movement of the post from the stored position to the fully raised active position comprising an "L"-shaped finger having a vertical and a horizontal section in a slot in the sleeve, said slot situated just above the upper sleeve portion, said vertical section of the finger shaped to be turned by a key, and said horizontal section of the finger extending into the cavity of the cylindrical post in stored position, a rubber cushion for cushioning an impact from lowering the post into the sleeve below grade level to a stored position, and a hollow tube traversing a horizontal cross-section of the post above the spiral threading for receiving a rope used to connect the bollard to other barriers.

2. A simple, manually operable, retractable, safe and versatile bollard for use as a traffic barrier, comprising:

a stainless steel hollow cylindrical sleeve situated below and flush with a grade level and open at a top end, a stainless steel hollow cylindrical post slidably disposed in said hollow cylindrical sleeve, said hollow cylindrical post including a bottom post portion, the post capable of being raised from a stored position in the sleeve to a fully raised active position above the grade level to function as a barrier, the post having an inside cavity, the bottom post portion including spiral threading on an outside part thereof, an upper sleeve portion of the sleeve having a length approximately equal to a length of the spiral threading and containing spiral grooves adapted for receiving the spiral threading after the post is disposed so that an upper part of the spiral threading reaches a lower part of the spiral grooves and the post is turned clockwise, a handle of the cylindrical post formed by a top edge of the post for raising and lowering said cylindrical post, said top edge being smooth enough so that said handle is incapable of being grasped without a controlling key, a safety lock to control movement of the post from the stored position to the fully raised active position comprising an "L"-shaped finger having a vertical and a horizontal section in a slot in the sleeve, said slot situated just above the upper sleeve portion, said vertical section of the finger shaped to be turned by a key, and said horizontal section of the finger extending into the cavity of the cylindrical post in stored position, a rubber cushion for cushioning an impact from lowering the post into the sleeve below grade level to a stored position, and a hollow tube traversing a horizontal cross-section of the post above the spiral threading for receiving a rope used to connect the bollard to other barriers.

3. The bollard of claim 2, wherein said bollard includes a spring-loaded double-lock containing a spring and a rod, the double-lock placed in a horizontal groove that traverses a diameter of the post for preventing the post from being turned and lowered when the post is in fully raised active position, said spring-loaded double-lock situated just above the grade level when the post is in fully raised active position, said spring and rod being biased in a direction of a side wall and an opposite side wall of the post and releasable by a second key inserted in the horizontal groove at the side wall of the post, said rod forming two lips outside the side walls of the post when the spring and rod are released.

4. The bollard of claim 2, wherein the top edge of the post is sloped downward from a centered aperture toward an outer circumference of the post for drainage purposes, wherein the centered aperture forms a passageway to the inside cavity, and wherein the post can be grasped by inserting an "I" shaped controlling key in said aperture, turning the controlling key so that the controlling key is in a void between the top edge and a flange extending below the top edge and then lifting the controlling key.

5. The bollard of claim 2, wherein the top edge has a smooth outer surface in which lettering designating a street location may be engraved.

6. A simple, manually operable, retractable, safe and versatile bollard for use as a traffic barrier, comprising:

a stainless steel hollow cylindrical sleeve situated below and flush with a grade level and open at a top end, a stainless steel hollow cylindrical post slidably disposed in said hollow cylindrical sleeve, said hollow cylindrical post including a bottom post portion, the post capable of being raised from a stored position in the sleeve to a fully raised active position above the grade level to function as a barrier, the post having an inside cavity, the bottom post portion including spiral threading on an outside part thereof, an upper sleeve portion of the sleeve having a length approximately equal to a length of the spiral threading and containing spiral grooves adapted for receiving the spiral threading after the post is disposed so that an upper part of the spiral threading reaches a lower part of the spiral grooves and the post is turned clockwise, a handle of the cylindrical post formed by a top edge of the post for raising and lowering said cylindrical post, said top edge being smooth enough so that said handle is incapable of being grasped without a controlling key, a safety lock to control movement of the post from the stored position to the fully raised active position comprising an "L"-shaped finger having a vertical and a horizontal section in a slot in the sleeve, said slot situated just above the upper sleeve portion, said vertical section of the finger shaped to be turned by a key, and said horizontal section of the finger extending into the cavity of the cylindrical post in stored position, a rubber cushion for cushioning an impact from lowering the post into the sleeve below grade level to a stored position, a hollow tube traversing a horizontal cross-section of the post above the spiral threading for receiving a rope used to connect the bollard to other barriers, and a spring-loaded double-lock placed in a horizontal groove that traverses a diameter of the post for preventing the post from being turned and lowered when the post is in fully raised active position, said spring-loaded double-lock situated just above the grade level when the post is in fully raised active position.

7. The bollard of claim 6, wherein the top edge of the post is sloped downward from a centered aperture toward an outer circumference of the post for drainage purposes, wherein the centered aperture forms a passageway to the inside cavity, and wherein the post can be grasped by inserting an "I" shaped controlling key in said aperture, turning the controlling key so that the controlling key is in a void between the top edge and a flange extending below the top edge and then lifting the controlling key.

8. The bollard of claim 6, wherein the top edge has a smooth outer surface in which lettering designating a street location may be engraved.

* * * * *